US012806482B2

(12) United States Patent
Lay et al.

(10) Patent No.: US 12,806,482 B2
(45) Date of Patent: Nov. 24, 2026

(54) MULTIFUNCTIONAL BALL SHAGGER WITH PEDESTAL ACCESS MODE

(71) Applicant: World Sports Products, Inc., St. George, UT (US)

(72) Inventors: Joseph Coleman Lay, St. George, UT (US); William Coleman Lay, St. George, UT (US)

(73) Assignee: World Sports Products, Inc., St. George, UT (US)

( * ) Notice: Subject to any disclaimer, the term of this patent is extended or adjusted under 35 U.S.C. 154(b) by 431 days.

(21) Appl. No.: 18/607,359

(22) Filed: Mar. 15, 2024

(65) Prior Publication Data

US 2025/0288874 A1 Sep. 18, 2025

(51) Int. Cl.
*A63B 47/02* (2006.01)
*A63B 47/00* (2006.01)

(52) U.S. Cl.
CPC ..... *A63B 47/021* (2013.01); *A63B 47/002* (2013.01)

(58) Field of Classification Search
CPC ..... A63B 47/021
See application file for complete search history.

(56) References Cited

U.S. PATENT DOCUMENTS 5,060,996 A 10/1991 Garnes
5,340,179 A 8/1994 Rubin
5,466,027 A 11/1995 Hockey
5,476,297 A 12/1995 Lombard
5,988,716 A 11/1999 Liao
6,422,621 B1 * 7/2002 Tandlich ..... A63B 47/021 414/440
8,172,703 B2 5/2012 Lay
8,191,945 B2 6/2012 Compton
8,496,545 B2 7/2013 Lay
8,747,259 B2 6/2014 Lay
8,801,061 B2 8/2014 Holt
9,445,545 B2 9/2016 Pope et al.
9,820,439 B1 * 11/2017 Tung ..... A47L 13/00
9,975,021 B1 5/2018 Sokolik
10,039,960 B2 8/2018 Olivieri
10,201,124 B2 2/2019 Pope et al.
10,556,155 B2 2/2020 Nelson
(Continued)

OTHER PUBLICATIONS amazon.com, Zozen Nut Gatherer, screenshot Nov. 16, 2023, 3 pages, https://www.amazon.com/dp/B0B2MFGD9B?_encoding=UTF8&ref_=cm_sw_r_em_ud_dp_NVQQENSR9RGQRSCD5KJ5&th=1.

(Continued)

*Primary Examiner* — Daniel Jeremy Leeds
(74) *Attorney, Agent, or Firm* — Madson IP, P.C.

(57) ABSTRACT

A multifunctional ball shagger is maneuverable between a ball shagging mode for retrieving randomly scattered balls resting on the ground and a pedestal access mode for presenting access to retrieved balls at a comfortable height. The multifunctional ball shagger has a rotatable ball basket connected to a handle. The rotatable ball basket has an axis of rotation and a pair of spaced rotatable hubs that capture and secure arc rods forming a basket defining an interior volume between each rotatable hub and inside of the arc rods. A support assembly receives the handle of the ball shagger in an upright disposition for storage or easy transport or for positioning in the pedestal access mode.

10 Claims, 9 Drawing Sheets

(56) References Cited

U.S. PATENT DOCUMENTS

| | | | |
|---|---|---|---|
| 10,844,625 | B2 | 11/2020 | Annas |
| 10,933,294 | B2 | 3/2021 | Colling |
| 11,154,763 | B1 | 10/2021 | Lay |
| 11,235,216 | B1 | 2/2022 | Dickerson et al. |
| 11,612,788 | B2 | 3/2023 | Bright |
| 2002/0092862 | A1 | 7/2002 | Threadgill, Jr. |
| 2011/0221219 | A1 | 9/2011 | Heaton |
| 2011/0269564 | A1 | 11/2011 | Mitchell et al. |
| 2021/0032897 | A1 | 2/2021 | Hutnak |
| 2021/0178243 | A1 | 6/2021 | Colling et al. |
| 2021/0299532 | A1 | 9/2021 | Chee |
| 2022/0062733 | A1 | 3/2022 | Thornton et al. |
| 2022/0355180 | A1 | 11/2022 | Colling et al. |
| 2023/0053895 | A1 | 2/2023 | Sugi et al. |

OTHER PUBLICATIONS

Combined sreenshots GOOGLE Search, Swifty Direct tennis ball shagger ebay, 2 pages, combined with EBAY, Professional Tennis Ball Collector Tennis Ball Pick up Machine for Club Use, 2 pages, screenshots Mar. 14, 2024.

* cited by examiner

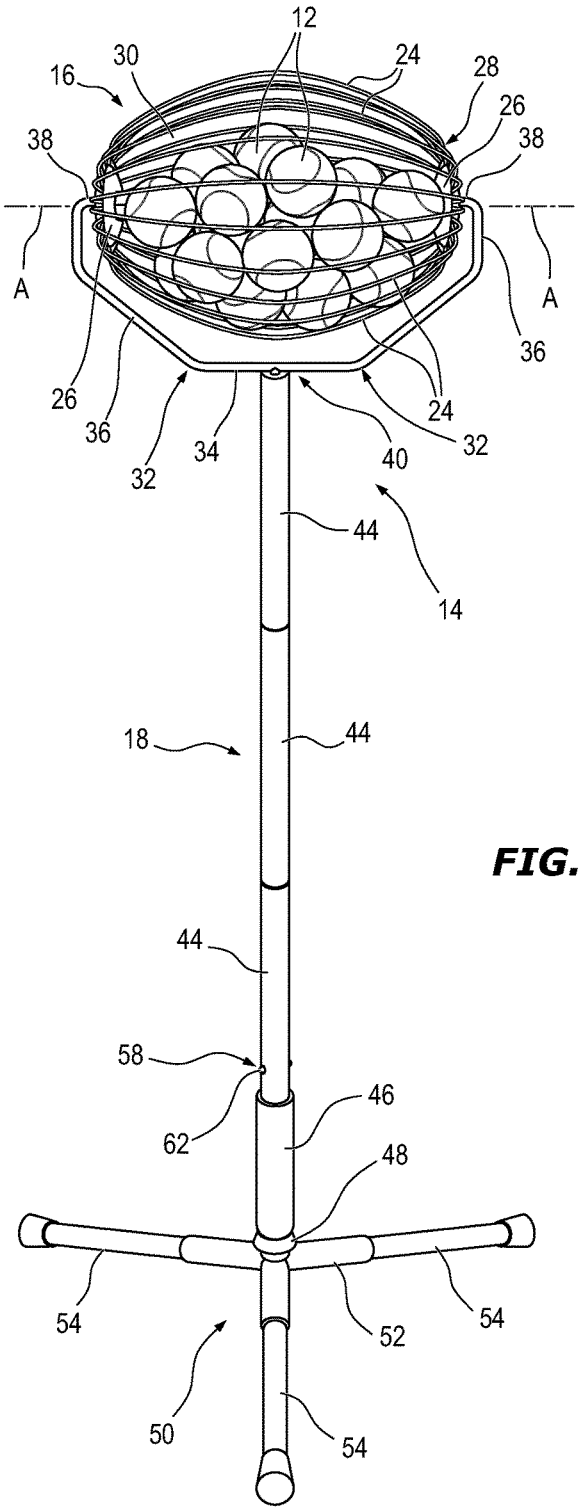
FIG. 3
FIG. 4
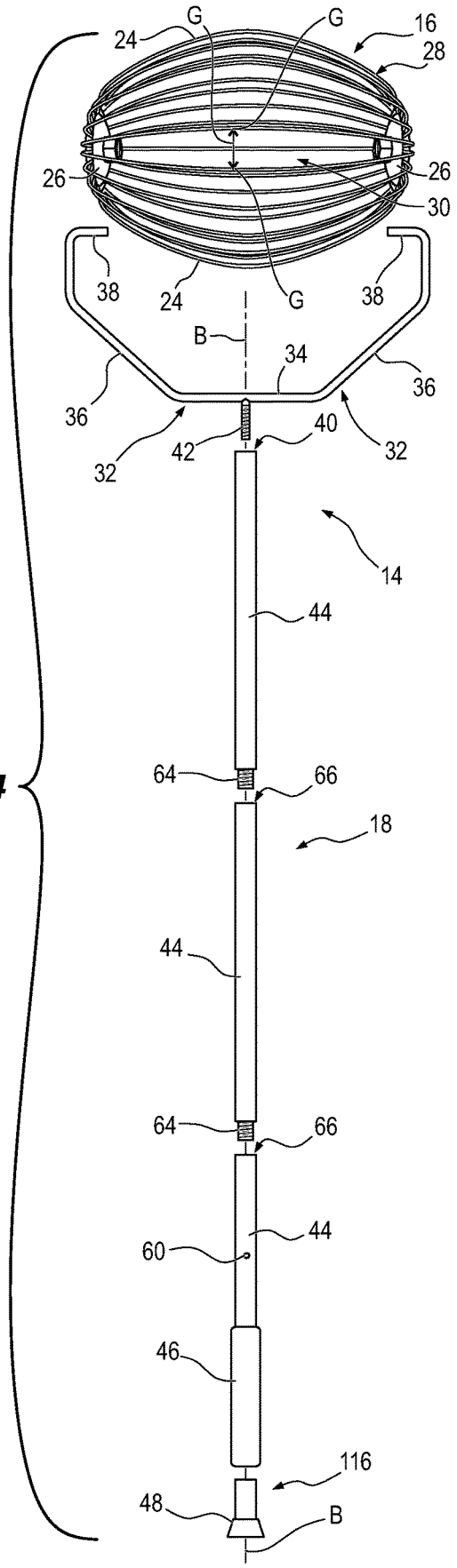

MULTIFUNCTIONAL BALL SHAGGER WITH PEDESTAL ACCESS MODE

BACKGROUND OF THE INVENTION

1. Field of the Invention

The present invention relates to ball retrieval devices, and more particularly, to a multifunctional ball shagger for retrieving randomly scattered balls. Additionally, the present disclosure relates to the field of recreational equipment, and more specifically, to sports training equipment.

2. The Relevant Technology

In many sporting events players participate by pitching, hitting, catching, and/or fielding balls. During training, such players may practice within specialized enclosures such as batting cages, bullpen enclosures, and the like that are enclosed by netting or in less confined space such as on a practice field, court, or in a ballpark. The very nature of such practice/training activity presupposes that not all balls thrown, or hit are caught or fielded. Whether the practicing activity is done individually, in a small group, or as a team, the balls used may come to rest randomly scattered within the enclosure or about the court, practice field, or ballpark. Retrieval of such randomly scattered balls (such retrieval or gathering is known in sports-related nomenclature as shag or shagging) may require retrieval and transport several times during a practice or training session.

Shagging balls can be a tedious task and, without assistance, may require person doing the shagging to bend over numerous times to pick up the balls. Also, without assistance, carrying several balls at once while transporting them to a different location may result in accidentally dropping one or more balls, thereby requiring more bending over.

As a result, devices such as pitch-back machines have been developed to capture slightly errant pitches or non-hit pitches that capture and direct balls to be propelled back to the thrower. However, such devices do not address the issue of randomly scattered balls strewn about a playing field.

Accordingly, a need exists for a ball shagger that is capable of picking up, transporting, and positioning the retrieved balls for easy access. Specifically, that need is addressed by a new multifunctional ball shagger with a pedestal access mode is disclosed herein.

Further, a need exists for a ball shagger that is capable of picking up, transporting, positioning various sized balls (such as baseballs, softballs, tennis balls, cricket balls, bocce balls, etc.).

BRIEF SUMMARY OF THE INVENTION

The present invention has been developed in response to the present state of the art, and in response to the problems and needs in the art that have not yet been fully solved and is not currently available. The present invention provides a new multifunctional ball shagger having a ball shagging mode for retrieving randomly scattered balls resting on the ground and a pedestal access mode for presenting access to retrieved balls at a comfortable height.

The multifunctional ball shagger of the present invention is a ball shagger having a rotatable ball basket connected to a handle and a support assembly for receiving the ball shagger in an upright disposition. Preferably, the support assembly may be placed on a supporting surface (such as on the ground or on a pitching mound) and has a base mount (which may or may not have a tripod or quadpod structure), legs, and a centering column. The centering column receives the end of the handle and serves to maintain the handle upright. In some embodiments, the centering column is cup-like receiving the handle within the hollow of the centering column, while in other embodiments the end of the handle is hollow, and the centering column is inserted into that hollow end. Still, in another embodiment, the handle has a funnel-shaped receiving end, that facilitates the connection of the handle to the centering column of the support assembly. One exemplary embodiment has a funnel-shaped receiving end that has a hollow frustoconical portion and a tubular portion, where the hollow frustoconical portion guides the centering column into the tubular portion. Additionally, the funnel-shaped receiving end urges detent push pins on the centering column inward to permit unincumbered insertion of the centering column into the hollow end of the handle. This assists the user in maneuvering the end of the handle over the centering column and depresses the detent push pins to allow insertion without needing to bend over.

The rotatable ball basket has an axis of rotation, a plurality of arc rods, and a pair of spaced rotatable hubs. Each rotatable hub captures and secures an end of each arc rod such that each arc rod is spaced from each adjacent arc rod, thereby forming a basket defining an interior volume between each rotatable hub and inside of the arc rods.

The multifunctional ball shagger is in the pedestal access mode when the ball shagger handle is secured to the support assembly such that the handle is disposed upright to support and hold the rotatable ball basket above the supporting surface at a predetermined pedestal height. In some embodiments, the predetermined pedestal height may be adjustable to accommodate users of various different heights comfortably.

The multifunctional ball shagger is in the ball shagging mode when the ball shagger handle is disengaged from the support assembly and maneuvered to a position angled to the ground such that the handle can be grasp comfortably in a user's hand while the rotatable ball basket engages the ground and may be rolled over the ground and directed towards randomly scattered balls resting on the ground to be retrieved into the interior volume of the rotatable ball basket.

Each arc rod has a contour having embeddable ends at each end of the arc rod, a radial arm extending from each embeddable end to an elbow, and an arc portion extending between each elbow. Each rotatable hub captures and secures one of the embeddable ends of each arc rod such that each arc rod is spaced from each adjacent arc rod, thereby forming a basket defining an interior volume between each rotatable hub and inside of the arc rods.

The rotatable ball basket is connected to the handle by a basket holder having a two-pronged configuration with a central portion from which each prong extends. Each prong has an axle centered about the axis of rotation of the rotatable hub that aligns with the axle of the other prong also centered about the axis of rotation. Further, the central portion also has a connector that connects the basket holder to the handle. The connector may permit rotation about a longitudinal axis of the handle, or the connector may be secured against such rotation.

Each rotatable hub has an inner cap and an outer cap. The inner cap has a flat base plate with an obverse side and a reverse side, a central axis bore, a circular array of pin holes, and a peripheral wall extending outward from the obverse side. Each pin hole is spaced equidistant from each next adjacent pin hole. The peripheral wall is divided by spacing slots with each spacing slot being spaced equidistant from each next adjacent spacing slot. Preferably, there are the same number of pin holes as spacing slots, and each pin hole lies on a radius extending from the axis of rotation through that pin hole and the spacing slot (radially related to the pin hole) is oriented to align along the radius. For purposes of this disclosure a pin hole is radially related to a spacing slot if the radius extends through both the pin hole and the spacing slot.

The outer cap is dome-shaped with a convex reverse side and a concave obverse side and has an aligning central axis bore and a peripheral base wall divided by corresponding spacing slots. The inner cap and outer cap of each rotatable hub are connected in overlapping rotational alignment such that each spacing slot of the inner cap aligns with one of the corresponding spacing slots of the outer cap. Also, each rotatable hub is disposed with the reverse side of the inner cap facing inwardly (i.e., facing the interior volume of the basket) and the convex obverse side of the outer cap facing outwardly with the central axis bore and the aligning central axis bore being centered about the axis of rotation of the rotatable ball basket.

Each embeddable end of each arc rod is embedded in one or the other of the inner caps by inserting it into one of the pin holes such that the radial arm of the arc rod is captured between the radially related spacing slot and its corresponding spacing slot. When so captured, an exterior portion of the radial arm extends radially outward from the rotatable hub to the elbow. The length of the exterior portion of the radial arm together with the stiffness of the arc rod are principal factors in determining the amount of resilient deflection the arc rod will tolerate. For purposes of this disclosure the term "resilient deflection" means the amount of deflection that any portion of any arc rod may withstand without being deformed or damaged while maintaining its resiliency when the rotatable ball basket retrieves a ball into its interior volume or when a ball is accessed and removed from the rotatable ball basket.

Additionally, each arc rod has a midpoint and the transverse distance between the midpoints of adjacent arc rods ranges between an open space distance that is the maximum transverse distance between non-deflected adjacent arc rods, and a yawn opening distance that is the open space distance plus the sum of the distances of maximum resilient deflection of each adjacent arc rod. Because any ball that passes into or out of the rotatable ball basket must pass between adjacent arc rods, any ball having a diameter less than the open space distance cannot be retrieved and any ball having a diameter greater than the yawn opening distance cannot be retrieved or removed without deforming or damaging one or more arc rods.

These limits set general parameters for the diameter of balls, but other factors determine an operative range of diameters which will determine optimum efficiency in the use of the ball shagger. For example, a rotatable ball basket having an open space distance ranging between 27 mm and 33.5 mm (approximately 1.063 in. to 1.32 in.) and designed specifically to retrieve and dispense softballs and baseballs. Additionally, Other types of balls of similar size to baseballs and softballs (for example, cricket balls, oversized tennis balls, some bocce balls, etc.), though not specifically designed for such other balls, likely are retrievable to be maintained within the ball basket, subject to the weight of the other balls not being significantly heavier than baseballs and softballs. For perspective, a 12-inch softball has a 3.82-inch diameter, and standard baseballs range from 2.86 inches to 2.94 inches in diameter.

A ball basket specifically designed for handling softballs and baseballs does not handle golf balls very well (in the U.S., regulation golf balls cannot have a diameter less than 1.68 inches). Although, a regulation golf ball has a diameter of 1.68 inches which is greater than the 1.063 in. open space distance, some golf balls can be retrieved and retained within the ball basket, but if other balls are added (whether golf balls or other larger balls) there comes a point where the weight exerted on one or more golf balls will push one or more golf balls out or the arc rods may be deflected (for example, when picking up a softball or a baseball) so that they can no longer retain golf balls that would otherwise rest on the deflected arc rods. Simply put, because balls are round and the ball basket interior volume is round, any ball will only be supported by no more than two adjacent arc rods. Consequently, if those adjacent arc rods are deflected away from each other, enlarging the open space distance, either by retrieving a larger diameter ball, or by the shear weight of other balls being exerted on a golf ball that will cause the arc rods to deflect sufficiently to allow that golf ball to fall out of the ball basket.

In some embodiments, the handle has a funnel-shaped receiving end that facilitates secure connection of the handle to the support assembly such that the handle is disposed upright, and the rotatable ball basket is held above the supporting surface at a predetermined pedestal height.

Also, transitioning the multifunctional ball shagger from the ball shagging mode where a user directs the rotatable ball basket over the ground to encounter and retrieve randomly scattered balls into the interior volume of the rotatable ball basket to the pedestal access mode involves inverting the handle of the multifunctional ball shagger so that the rotatable ball basket disengages with the ground and is disposed above the ground, targeting the handle for connection to the support assembly positioned on a supporting surface, and connecting the handle securely to the support assembly such that the handle is disposed upright, and the rotatable ball basket is held above the supporting surface at a predetermined pedestal height.

Then, transitioning the multifunctional ball shagger from the pedestal access mode to the ball shagging mode involves disconnecting the handle from the support assembly, rotating the handle to an angle with the ground, and positioning the rotatable ball basket to engage the ground so that the rotatable ball basket may be directed over the ground to encounter and retrieve randomly scattered balls into the interior volume of the rotatable ball basket.

These and other features of the present invention will become more fully apparent from the following description or may be learned by the practice of the invention as set forth hereinafter.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which:

FIG. 3 is a perspective view of an exemplary embodiment of a multifunctional ball shagger configured in the pedestal access mode showing various components thereof.

FIG. 4 is an exploded view of an exemplary embodiment of the multifunctional ball shagger of FIG. 3 configured in an exploded depiction of the ball shagging mode.

FIG. 5A is an exploded view of an exemplary support assembly as a tripod depicting the base mount, legs, and centering column. FIG. 5B is an alternative exemplary support assembly wherein the base mount is an anchoring base (weighted or not) with a centering column. FIG. 5C is yet another alternative exemplary support assembly wherein the base mount is a stake (as depicted, having dual spikes) with a centering column.

FIGS. 9A-C depict various views of an exemplary inner cap for the basket hub, wherein FIG. 9A is a perspective view of the obverse side of the inner cap; FIG. 9B is a side perspective view of the inner cap; and FIG. 9C is a perspective view of the reverse side of the inner cap. The exemplary inner cap depicted facilitates uniform wire spacing by capturing and securing each arc rod in pin holes and spacing slots.

FIGS. 10A-C depict various views of an exemplary outer cap for the basket hub, wherein FIG. 10A is a side perspective view of the outer cap; FIG. 10B is a perspective view of the convex reverse side of the outer cap; and FIG. 10C is a perspective view of the concave obverse side of the outer cap. The exemplary outer cap depicted facilitates uniform wire spacing by clamping each arc rod within the spacing slots of the inner cap and aligned, opposite facing outer spacing slots.

FIGS. 11A-C depict various views of an exemplary introducer funnel for disposition within the handle end, wherein FIG. 11A is a perspective side view of the introducer funnel;

FIG. 11B is a perspective end view of the frustoconical end of the introducer funnel; and FIG. 11C is a perspective end view of the insertion end of the introducer funnel.

Figure 1:
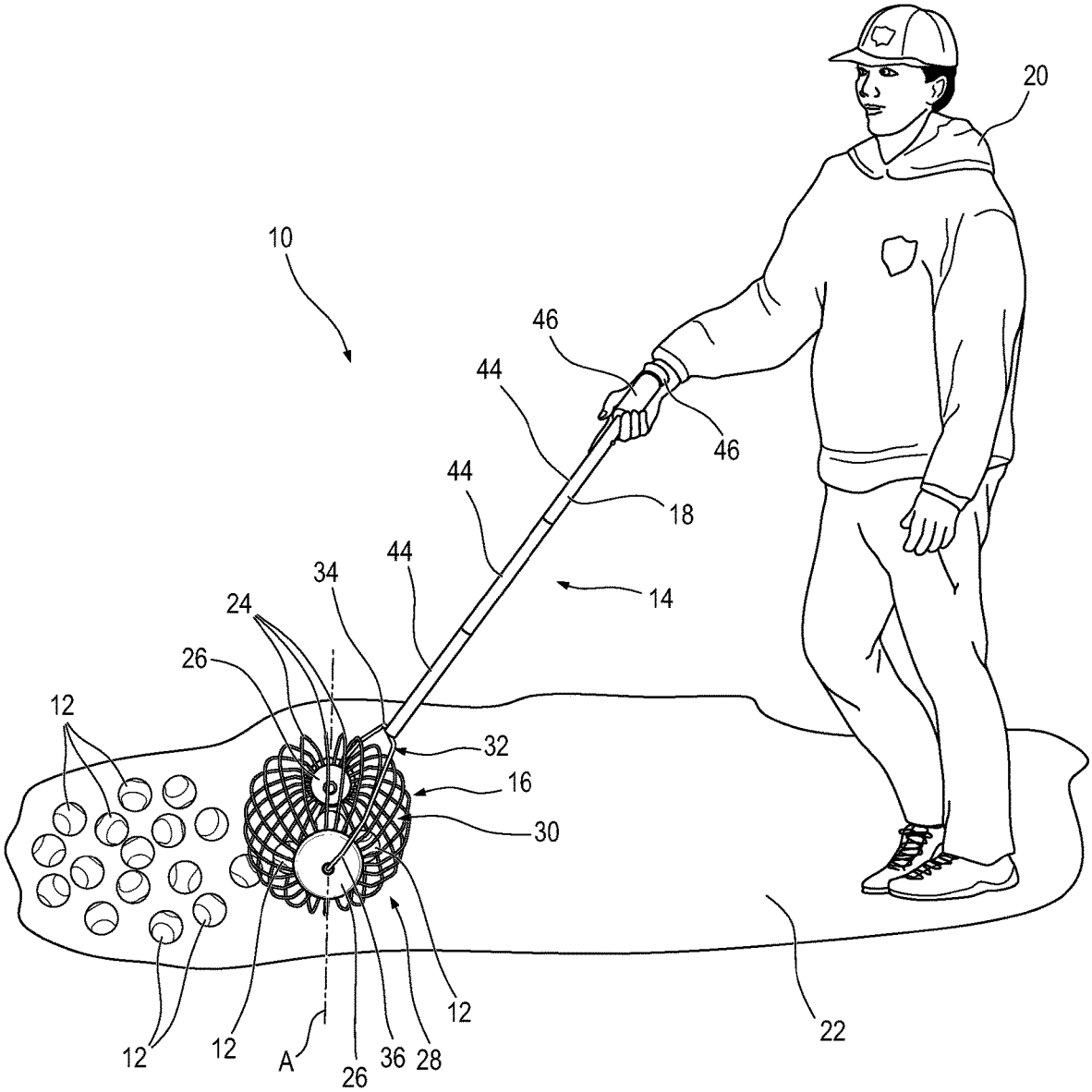
FIG. 1 is a perspective view of an exemplary embodiment of a multifunctional ball shagger in the ball shagging mode being operated by a user to pick up randomly located balls (a process known as shagging balls in baseball/softball nomenclature) into the interior of the ball basket.

REFERENCE NUMBERS multifunctional ball shagger 10
ball(s) 12
ball shagger 14
rotatable ball basket 16
handle 18
ball shagger/user/player 20
ground (or support surface) 22
arc rod(s) 24
rotatable hubs 26
basket (or ball basket) 28
interior volume 30
basket holder 32
central portion 34
prong(s) 36
axle(s) 38
connector 40
threaded shaft 42
handle section(s) 44
grip 46
funnel-shaped receiving end 48
support assembly 50
base mount 52
anchoring base 53
leg(s) 54
stake 55
centering column 56
spike(s) 57
detent assembly 58
detent bore(s) 60
detent push pin(s) 62
threaded male end(s) 64
female receiving end(s) 66
seating collar 68
fins 70
embeddable end(s) 72
end 74
radial arm(s) 76
elbow(s) 78
arc portion 80
midpoint 82
inner cap 84
outer cap 86
flat base plate 88
obverse side 90
reverse side 92
central axis bore 94
circular array of pin holes 96
peripheral wall 98
pin hole(s) 100
spacing slots 102
concave obverse side 104
convex reverse side 106
aligning central axis bore 108
peripheral base wall 110
corresponding spacing slots 112
exterior portion 114
introducer funnel 116
hollow frustoconical portion 118
tubular portion 120
female threaded end 122
screws 124
axis of rotation A
longitudinal axis B
double arrow C
spacing distance D
non-deflected distance E
arrow F
open space distance G

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

There are many types and sizes of balls that are used during sports training, skills development, and recreational enjoyment. For example, there are three sizes for regulation softballs, three sizes of cricket balls, baseballs range in diameter from 2.86 to 2.94 inches, T-balls are softer than baseballs and range from 2.86 to 3.02 inches, tennis balls range in diameter from 2.575 to 2.7 inches, pickleballs range in diameter from 2.874 to 2.972, racket balls have 2.25-inch diameters, some bocce balls range in size having generally similar diameters, and regulation golf balls can be larger than a 1.68-inch diameter, but are weight limited while certain practice golf balls are softer and may range in diameter from 2 to 2.5 inches. While using any of these types of balls (and other types of balls that are generally of similar diameters), the very nature of such practice/training/recreational activity presupposes that not all balls thrown, or hit are caught or fielded. Whether the practicing activity is done individually, in a small group, or as a team, the balls used may come to rest randomly scattered within the enclosure or about the court, practice field, or ballpark. Retrieval of such randomly scattered balls may require retrieval and transport several times during a practice or training session or during game play. Furthermore, shagging balls can be a tedious task and, without assistance, may require person doing the shagging to bend over numerous times to pick up the balls. Also, without assistance, carrying several balls at once while transporting them to a different location may result in accidentally dropping one or more balls, thereby requiring more bending over.

The invention of the present disclosure is quite versatile, making the shagging, transporting, and presenting for access of many different types of balls enjoyable in different situations. Obviously, every different situation should not be described in this disclosure when a representative example will sufficiently teach the invention and how it is used for not only the representative example but for many other uses that will be readily apparent to those of ordinary skill in the art who have been informed and taught by this disclosure. Consequently, for the sake of brevity and without compromising or limiting the teachings herein, the invention of this disclosure will be described in reference to exemplary, representative situations. Thus, the following detailed description of the embodiments of the representative example(s) of the present invention, as depicted in the figure(s), is not intended to limit the scope of the invention, as claimed, but is merely representative of one of many presently preferred embodiments of the invention.

FIG. 1 is a perspective view of an exemplary embodiment of a multifunctional ball shagger 10 in the ball shagging mode being operated to pick up randomly located balls 12 (a process known as shagging balls in baseball/softball nomenclature) and showing some balls having already been picked up. The multifunctional ball shagger 10 of the present invention is a ball shagger 14 having a rotatable ball basket 16 connected to a handle 18. As depicted, a ball shagger/user/player 20 is grasping the handle 18 which is angled towards the ground 22 so that the rotatable ball basket 16 rests on the ground 22.

The rotatable ball basket 16 has an axis of rotation A, a plurality of arc rods 24, and a pair of spaced rotatable hubs 26. Each rotatable hub 26 captures and secures an end of each arc rod 24 such that each arc rod 24 is spaced from each adjacent arc rod 24, thereby forming a basket 28 defining an interior volume 30 between each rotatable hub 26 and inside of the arc rods 24.

The rotatable ball basket 16 is connected to the handle 18 by a basket holder 32 (see also FIGS. 2-4, 6 and 8) having a two-pronged configuration with a central portion 34 from which each prong 36 extends. Each prong 36 has an axle 38 (best shown in FIG. 4) centered about the axis of rotation A of the rotatable hub 26 that aligns with the axle 38 of the other prong 36 also centered about the axis of rotation A. Further, the central portion 34 also has a connector 40 that connects the basket holder 32 to the handle 18. The connector 40 may be of any suitable type and may permit rotation about a longitudinal axis B of the handle 18, or the connector 40 may be secured against such rotation. As depicted, the connector 40 is a threaded shaft 42 that is threaded into a female threaded end (shown only in FIG. 12) in the handle 18 and may be secured from movement by an adhesive or not.

Figure 11A:
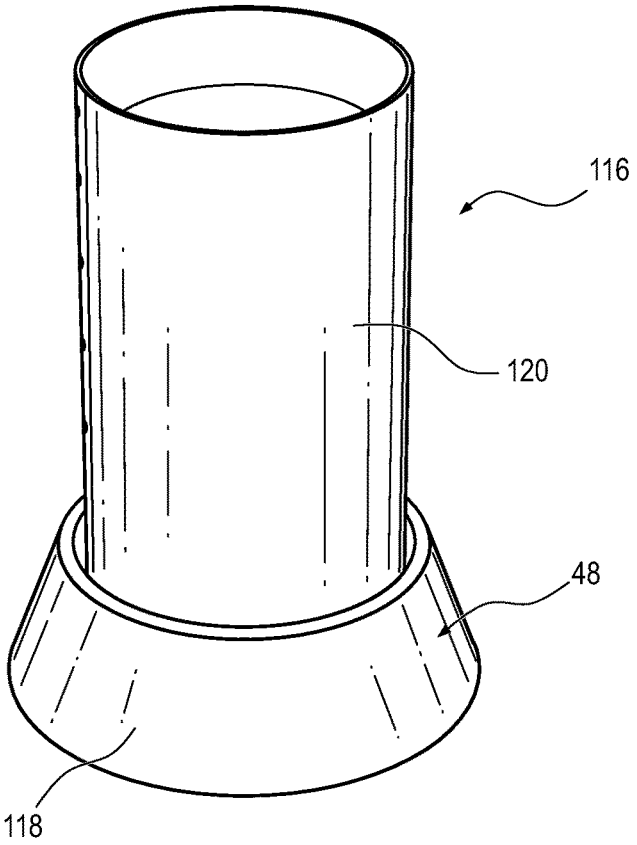
Figure 11C:
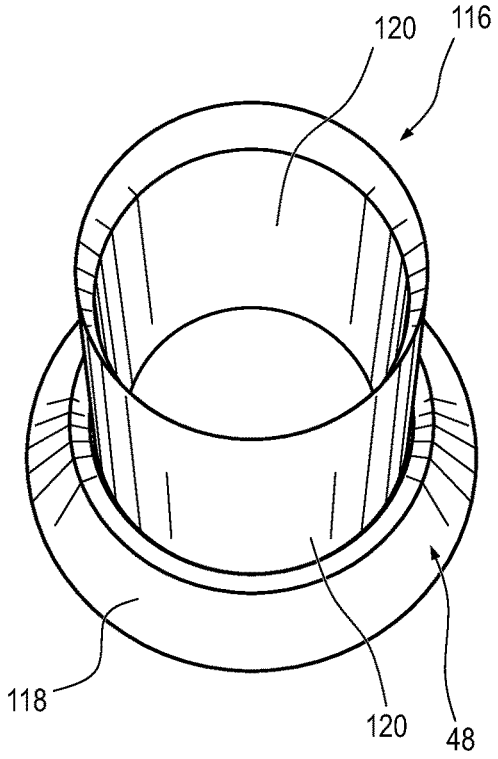
Figure 11B:
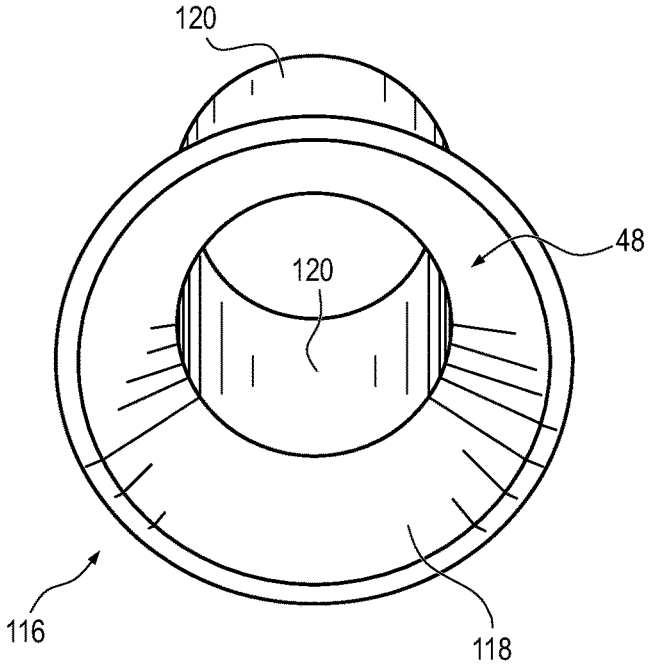

As depicted, the handle 18 is an assembly of handle sections 44 wherein one of the handle sections 44 connects to the basket holder 32, another handle section 44 has a grip 46 and a funnel-shaped receiving end 48 (i.e., the visible portion of introducer funnel 116 shown in its entirety in FIGS. 11A-C). Of course, alternatively the handle 18 could be made of a single piece and/or the funnel-shaped receiving end 48 need not be a separate component but may be as simple as a flared end of a hollow handle section 44 or hollow handle 18. Also, the handle 18 could be adjustable into different lengths in a number of different ways, including twist-locking telescoping sections. For example, adding or subtracting handle sections 44, or having handle sections 44 of different lengths that could be arranged in various combinations could change the length of the handle 18 to accommodate users 20 of different heights, short to tall.

Figure 2:
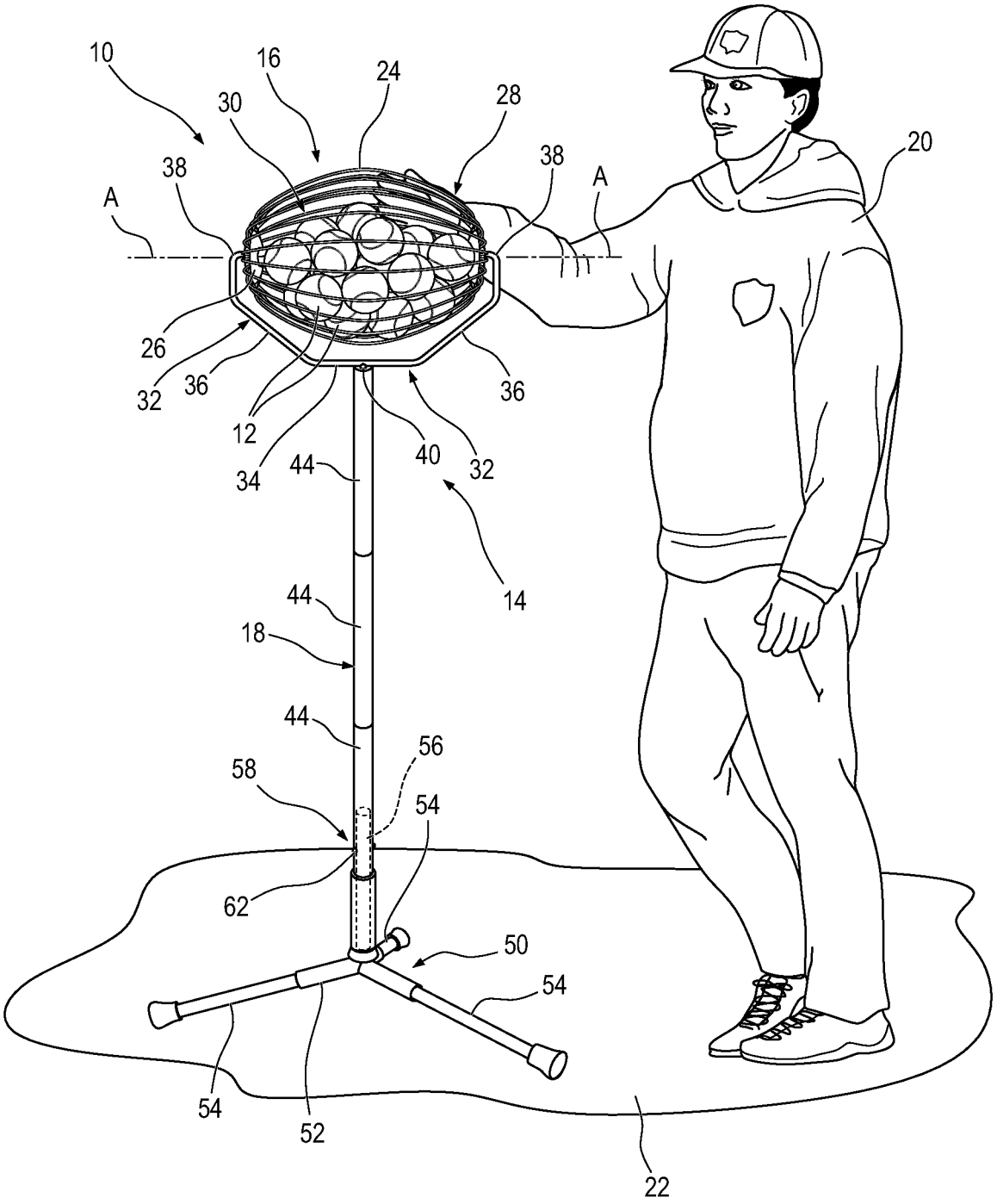
FIG. 2 is a perspective view of an exemplary embodiment of the multifunctional ball shagger of FIG. 1 in the pedestal access mode showing a user accessing the interior of the ball basket to retrieve a ball to be used for any number of activities such as pitching, hitting, throwing, fielding, etc.

FIG. 2 is a perspective view of the embodiment of the multifunctional ball shagger 10 of FIG. 1 in the pedestal access mode showing a user 20 accessing the interior volume 30 of the ball basket 32 to grasp and remove a ball 12 to be used for any number of activities such as pitching, hitting, throwing, fielding, etc. As depicted, the ball shagger 14 has been inverted and secured to a support assembly 50. The support assembly 50 is shown as a tripod resting on a support surface 22 which may be the ground 22 or may be a different surface like a pitching mound, a court, cement, or the like. The support assembly 50 may be of any suitable type such as, by way of example and not to be limited to these examples, a tripod, a quadpod, an anchoring base 53 (see FIG. 5B), a stake 55 (see FIG. 5C), modular (as depicted), or integrally formed. The support assembly 50, as shown in FIG. 2, has a base mount 52, legs 54, and a centering column 56 (shown in phantom lines because it is obscured by the grip 46 end of the handle 18, best shown in FIG. 5A).

Figure 5B:
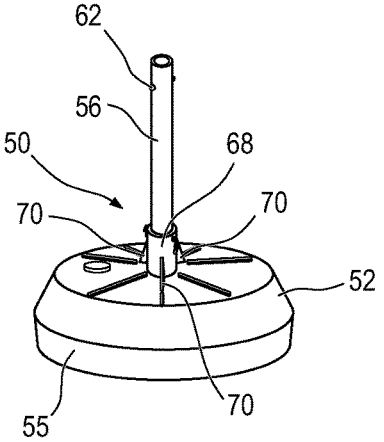
FIGS. 5A-C are perspective views of alternative embodiments of exemplary support assemblies.
Figure 5A:
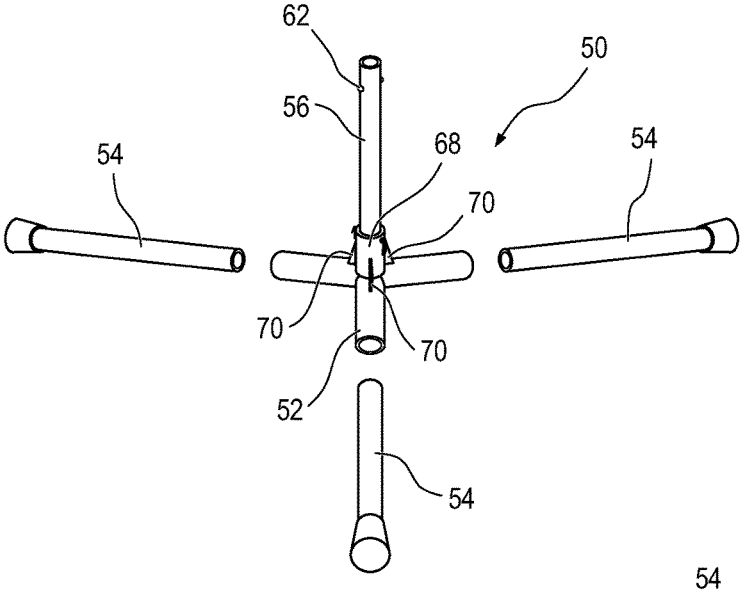

FIGS. 3-5A depict the assembly of the multifunctional ball shagger 10. FIG. 3 is a perspective view of an exemplary multifunctional ball shagger 10 configured in the pedestal access mode showing various components thereof and balls 12 within the interior volume 30 of ball basket 28. FIG. 4 is an exploded view of the exemplary multifunctional ball shagger 10 of FIG. 3 configured in an exploded depiction of the ball shagging mode. FIG. 5A is an exploded view of the support assembly 50 as an exemplary tripod depicting the base mount 52, legs 54, and centering column 56.

FIG. 3 depicts the multifunctional ball shagger 10 in the pedestal access mode with the ball shagger 14 perched securely on the support assembly 50. The ball shagger 14 handle 18 has a detent assembly 58 with one or more detent bores 60, shown proximate the grip 46, and the centering column 56 (obscured from view in FIG. 3) has one or more detent push pins 62 (best shown in FIGS. 5A and 12). The detent push pins 62 may be depressed without requiring the user 20 to bend over to manually depress the detent push pins 62 by advancing the handle 18 downward (see FIG. 6) so that the funnel-shaped receiving end 48 engages the centering column 56 and the funneling structure of the funnel-shaped receiving end 48 depressingly urges the detent push pins 62 inward to permit smooth insertion of the centering column 56. The detent push pins 62, when passing through detent bores 60, secure the handle 18 from rotational movement with respect to the centering column 56, and additionally prevents the support assembly 50 from unintentionally disengaging from the handle 18 if the ball shagger 14 is lifted and transported from one location to another while the centering column 56 is secured to the handle 18 by the detent assembly 58. Of course, those persons of skill in the art will understand that the handle 18 may be releasably secured to centering column 56 in any suitable manner, including but not limited to a ball locking pin assembly, a tightening a head cap screw or headless screw, or sizing the centering column 56 to frictionally press fit into the handle 18, etc.

FIG. 3 also depicts a number of same-sized balls 12 resting within the ball basket 28. The number of balls that will reliably remain within the ball basket 28 depends on a number of factors, including the diameter of the balls 12, whether each of the balls 12 has the same diameter or if the collection of balls 12 has mixed diameters, the weight of the balls 12 individually and collectively, and if there is frictional structure (such as seams, holes, dimples, etc.) that may affect ingress into or egress from the ball basket 28. For example, the ball basket 28 may reliably hold 24 baseballs, but only hold 12 softballs. Further, a mixture of softballs, baseballs, and golf balls, may allow a golf ball to egress either during retrieval or removal of a larger softball or baseball, or when weight exerted on a golf ball from other balls 12 cause that golf ball to deflect adjacent arc rods 24 allowing it to fall through the ball basket 28.

Turning now to FIG. 4, FIG. 4 depicts the assembly of the ball shagger 14 in an exploded view. The ball shagger 14 comprises, as shown top to bottom, 1) the ball basket 28 with rotatable hubs 26 holding a plurality of arc rods 24 in spaced relationship to each other, 2) the basket holder 32 with prongs 36 extending from the central portion 34 and having axles 38 and the connector 40, and 3) the handle 18 made from handle portions 44 and having the grip 46 and the funnel-shaped receiving end 48 which is shown to be a funnel introducer 116 (see FIGS. 11A-C).

The assembly of the ball basket 28 will be described below in detail. The rotatable hubs 26 receive the axles 38 of the basket holder 32 so that the ball basket 28 is free to rotate about the axles 38. As described above, the connector 40 is secured to the handle 18 by any suitable type of securement with the connector 40, depicted as an exemplary connection, being a threaded shaft 42.

Figure 12:
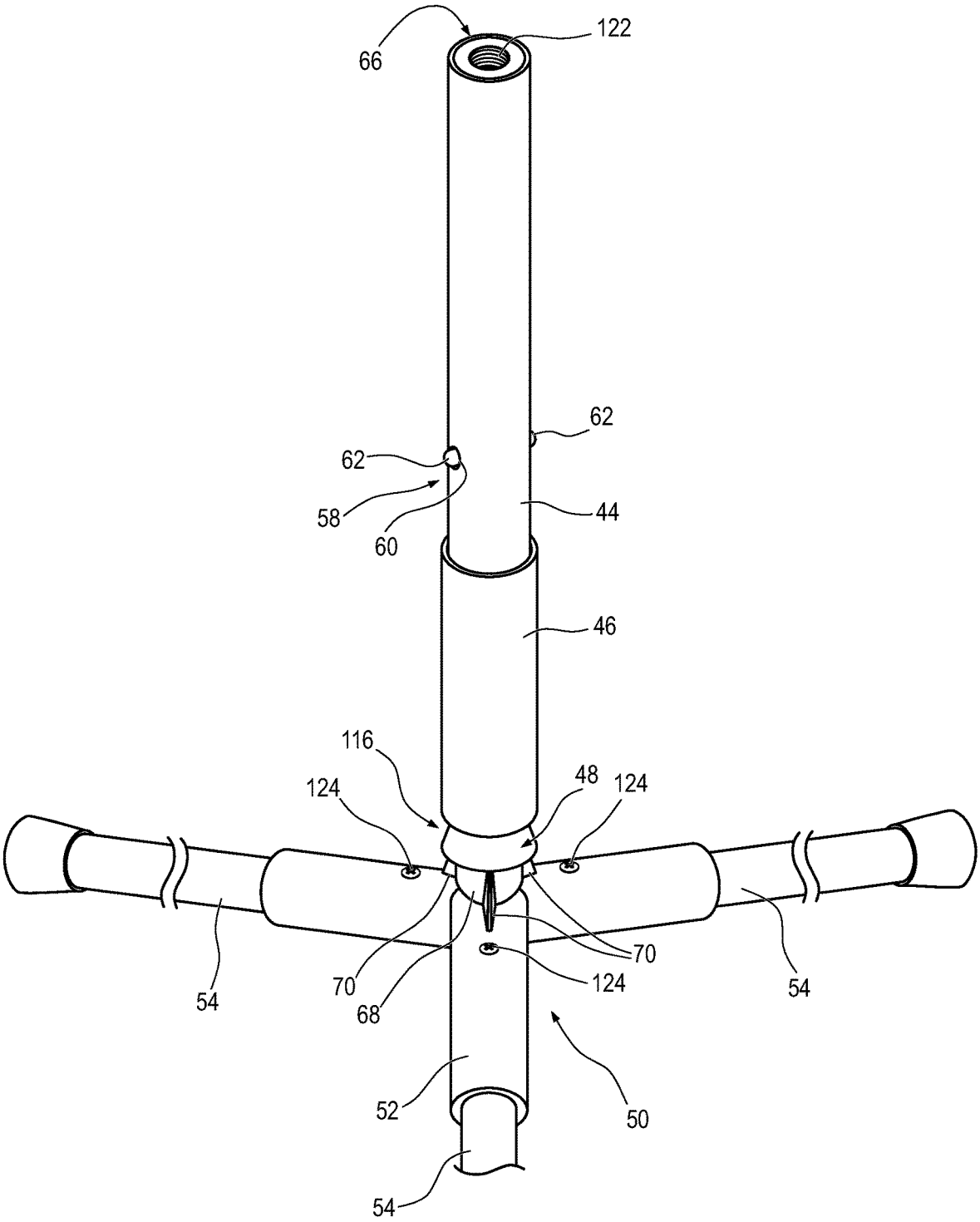
FIG. 12 is a perspective close-up view depicting a portion of the handle assembly as secured to the support assembly.

The handle 18 may be integrally formed or it may be formed from handle portions 44, as depicted. Again, connecting the handle portions 44 together may be done in any suitable manner. For example, threaded male ends 64 may be threaded into female receiving ends 66 (as shown and referenced in FIG. 4), or the handle portions 44 may be telescopically press fit, or the handle portions 44 may be secured using a detent assembly 58 similar to that described with respect to the handle 18 and support assembly 50 connection, or by telescoping handle portions 18 secured by a screw or bolt (such as shown in FIG. 12).

Additionally, as mentioned above, the handle 18 may be length adjustable. Again, there are many ways to provide length adjustability. For example, the handle portions 44 can be made to different lengths and the desired length can be achieved by selecting and connecting some or all of the different-length handle portions 44 to attain the desired length or telescoping handle portions 44 with twist locking mechanisms can be adjusted virtually infinitely between a minimum to a maximum length, or any other length adjustment known to those skill in the art could be used.

Figure 5C:
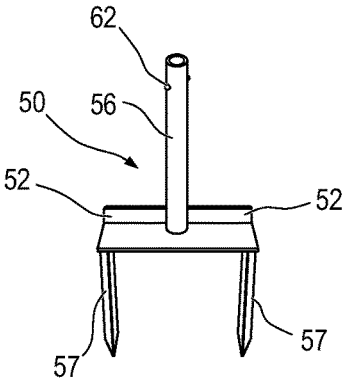

FIGS. 5A-C are perspective views of alternative embodiments of exemplary support assemblies 50. FIG. 5A depicts the support assembly 50 in an exploded view showing the legs 54 detached from the base mount 52 and the centering column 54 attached to the base mount 52. FIG. 5B is an alternative exemplary support assembly 50 wherein the base mount 52 is an anchoring base 53 that may be molded plastic, cast metal, a metal plate, or the like with a centering column 56. FIG. 5C is yet another alternative exemplary support assembly 50 wherein the base mount is a stake 55 (as depicted, having dual spikes 57) with a centering column 56.

In some exemplary embodiments, the base mount 52 has a seating collar 68 onto which the end of the handle 18 rests. See FIGS. 5A and 5B for example. The seating collar 68 may be formed integrally with the base mount 52 or attached to the base mount 52. In other embodiments, no seating collar 68 is used. See FIG. 5C for example. The seating collar 68 may have a frustoconical shape, a partial frustoconical shape, a ring shape with fins 70, or any other suitable shape. The seating collar 68 serves two principal purposes, one as a seat for the end of the handle 18 and another to urge the handle 18 to maintain its upright position even when the centering column 54 does not snugly fit within the handle 18.

FIG. 5B depicts an alternative exemplary support assembly 50. In this case, the support assembly has a molded plastic anchoring base 53 that may be weighted with any suitable ballast (such as cement, sand, water, metal, or the like) or may be unweighted. The anchoring base could also be made of cast metal or of any other suitable material.

FIG. 5C depicts yet another alternative support assembly 50. In this case, the support assembly 50 has a stake 55 configuration having a base mount 52 (that may serve as an anvil for pounding the spikes 57 into the ground 22 or may serve as footrest(s) for urging the spikes 57 into the ground 22. Other stake 55 configurations are also contemplated in this disclosure, for example, a single spike 57 stake 55 may be urged into the ground 22 such that the ground 22 serves as the base mount 52 and the portion of the stake 55 remaining above ground 22 serves as the centering column 56.

Figure 6:
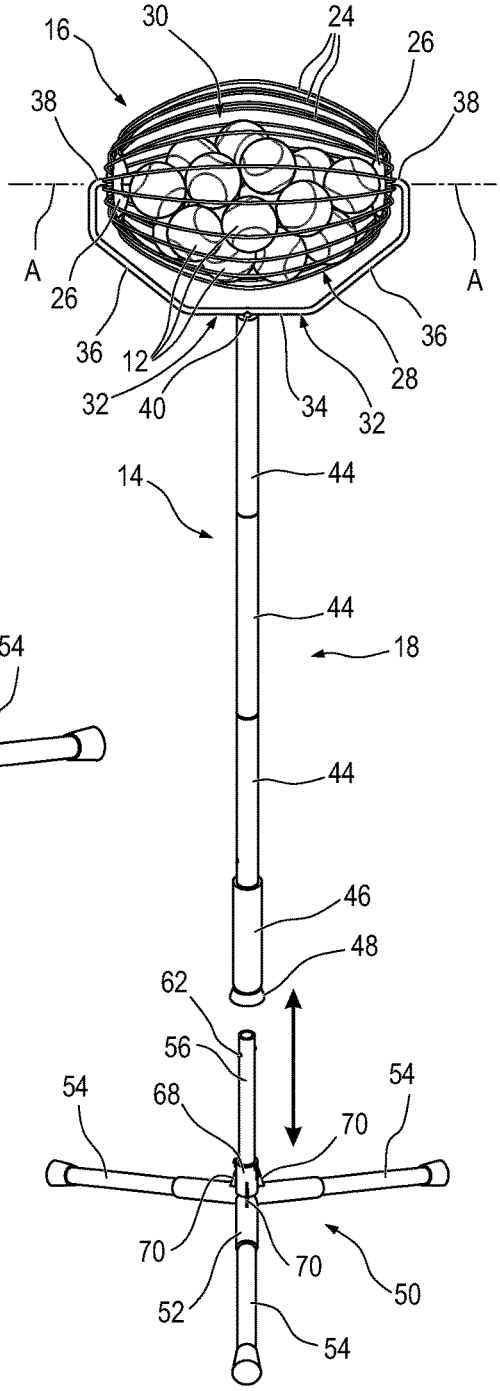
FIG. 6 is a perspective view of an exemplary embodiment of a multifunctional ball shagger configured for and depicting the transition movement from the ball shagging mode to the pedestal access mode and also the transition movement from the pedestal access mode to the ball shagging mode.

FIG. 6, a perspective view of an exemplary embodiment of a multifunctional ball shagger 10, depicts a representative configuration demonstrating transition movement from the ball shagging mode to the pedestal access mode and also the transition movement from the pedestal access mode to the ball shagging mode. A double arrow C shows directional movement of the ball shagger 14 downwardly to represent transitioning from the ball shagging mode to the pedestal access mode by connecting the ball shagger 14 handle 18 to the support assembly 50, and upwardly to represent transitioning from the pedestal access mode to the ball shagging mode by disconnecting the ball shagger 14 handle 18 from the support assembly 50.

While in the ball shagging mode, the ball shagger 14 may be directed to perform the ball shagging function such that the rotatable ball basket 16 rotates while traversing the ground 22 to encounter and retrieve randomly scattered balls 12 into an interior volume 30 of the rotatable ball basket 16. Transitioning the ball shagger 14 out of the ball shagging mode involves inverting the handle 18 of the ball shagger 14 so that the rotatable ball basket 16 disengages its contact with the ground 22 and the rotatable ball basket 16 is disposed above the ground 22. Then the end of the handle 18 is targeted for connection to the support assembly 50 disposed on a supporting surface 22 (which may be the ground 22). Advancing the end of the handle 18 to connect the handle 18 securely to the support assembly 50 such that the handle 18 is disposed upright, and the rotatable ball basket 16 is held above the supporting surface at a predetermined pedestal height, leaves the ball shagger 14 in the pedestal access mode.

While the handle 18 is connected securely to the support assembly 50, the ball shagger 14 may be transported easily from one location to another without disengaging the support assembly 50. Also, this configuration is ideal for storing the multifunctional ball shagger 10 disposed upright and occupies a minimal floor footprint during storage. Further, by positioning this configuration at a desired location for user 20 access to any balls 12 within the interior volume 30 of the ball basket 28, the ball shagger 14 is in the pedestal access mode.

To convert the ball shagger 14 from the pedestal access mode back to the ball shagging mode, the user 20 merely disconnects the handle 18 from the support assembly 50, rotates the handle 18 (reversing the inversion of the handle 18 performed to connect it with the support assembly 50) so that it becomes disposed at an angle to the ground 22, and positions the ball basket 28 to engage the ground 22.

Figure 7:
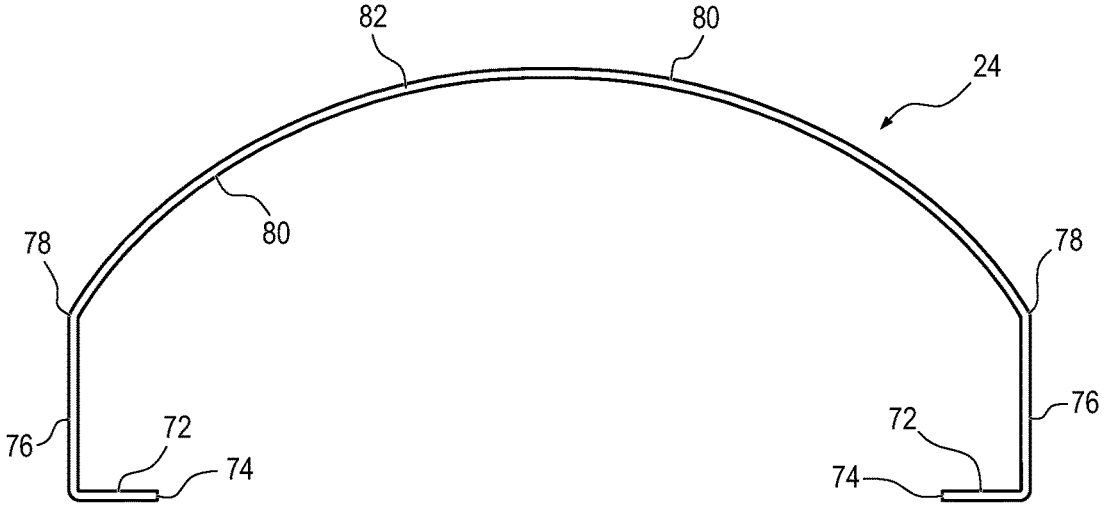
FIG. 7 is a plan view of an exemplary arc rod as removed from a ball basket illustrating an exemplary shape and various portions of the arc rod.

FIG. 7 is a profile view of an exemplary single arc rod 24 as removed from a ball basket 28 illustrating an exemplary shape and various portions of the arc rod 24. Each arc rod 24 has embeddable ends 72 at each end 74 of the arc rod 24, radial arms 76 extending from each embeddable end 72 to an elbow 78, and an arc portion 80 extending between each elbow 78. The arc portion 80 also has a midpoint 82. Each arc rod 24 is constructed from a solid wire (having a circular cross-section) that can be formed into a shape (such as shown in FIG. 7) and will hold that shape resiliently against deflecting force. For the arc rods 24 to withstand deflection caused when a ball 12 is retrieved into and removed from the ball basket 28, it is preferred that the diameter of the arc rod 24 be at least 2 mm (i.e., a 12-gauge wire). However, it should be understood that smaller or larger gauge wire could be used so long as it will resiliently hold its formed shape against deflective force. For example, a smaller gauge wire may be used to form arc rods 24 for ball shaggers 14 designed to specifically shag smaller diameter balls 12 (such as lightweight practice golf balls), while a larger gauge wire may be used to form arc rods 12 for ball shaggers 14 designed to specifically shag larger diameter balls 12 (such as exclusively for larger diameter softballs).

Figure 8:
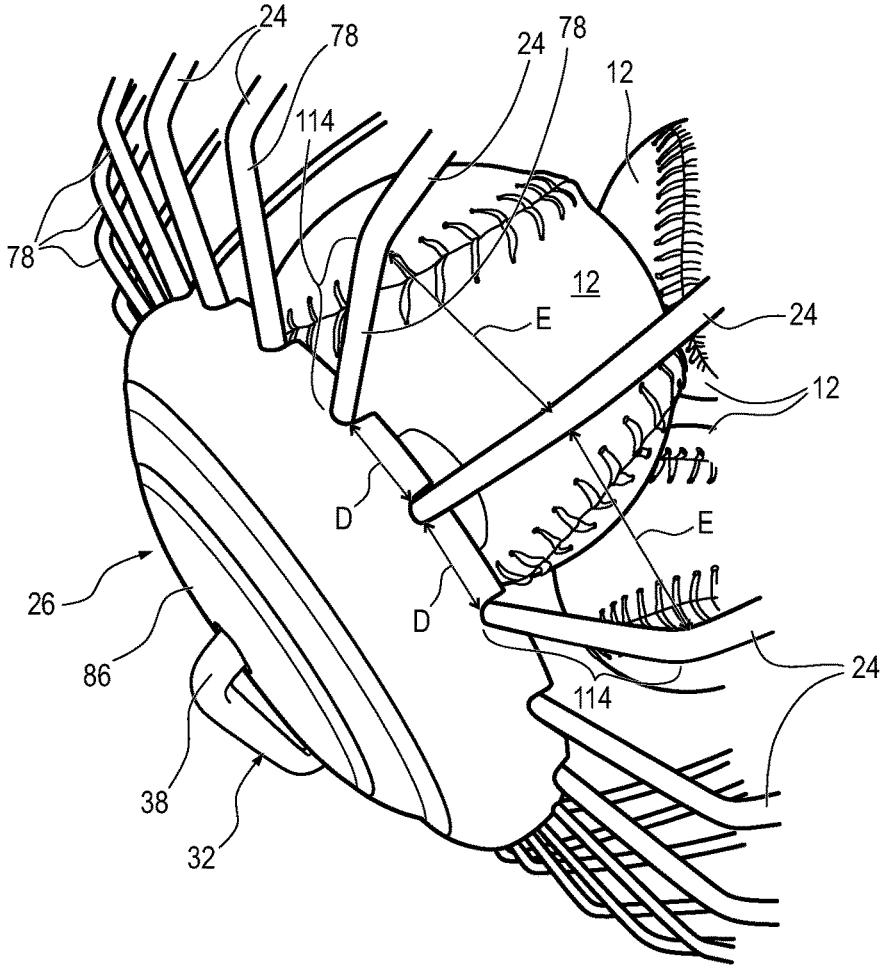
FIG. 8 is a perspective view of a portion of an exemplary ball basket showing one hub end and portions of a number of arc rods.

FIG. 8 depicts a view of a portion of an exemplary ball basket 28 showing one rotatable hub 26 and portions of a number of arc rods 24 with the rotatable hub 26 being rotatable about the axle 38 of one of the prongs 36 of the basket holder 32. Balls 12 are shown within the interior volume 30 of the ball basket 28. The arc rods 24 depicted show the uniformly spaced relationship of each arc rod 24 to each adjacent arc rod 24. Each arc rod 24 exits the rotatable hub 26 a spacing distance D from each adjacent arch rod 24. Also, the non-deflected distance E, at the elbow 78 of each arc rod 24 is the same distance to each adjacent arc rod 24.

Figure 9A:
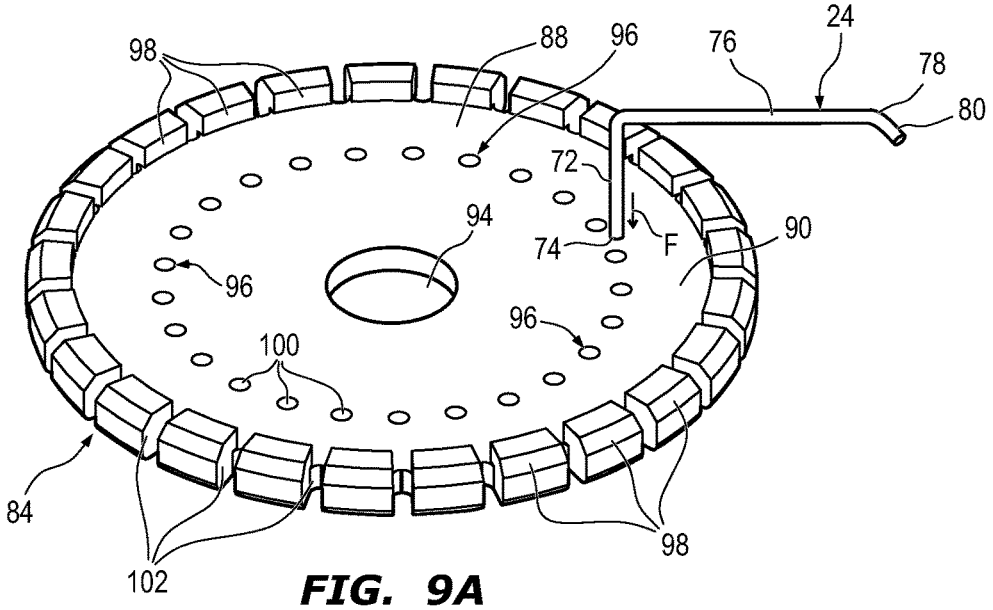
Figure 9B:
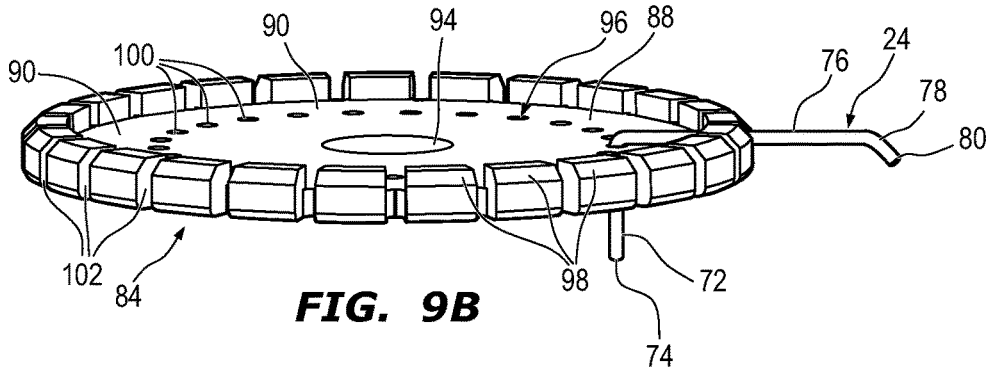
Figure 9C:
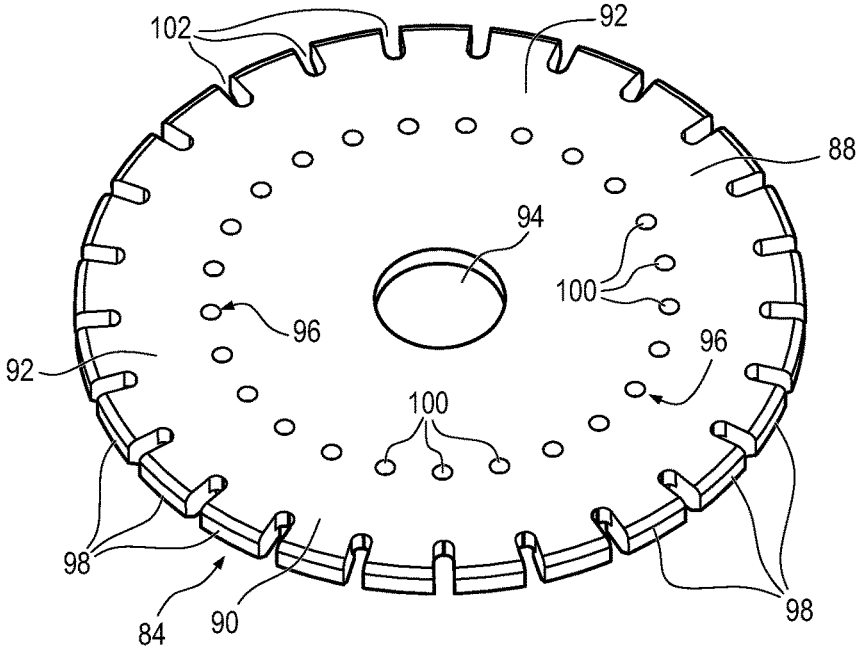

With reference to FIGS. 8, 9A-C, and 10 A-C, each rotatable hub 26 has an inner cap 84 and an outer cap 86. The inner cap 84 has a flat base plate 88 with an obverse side 90 and a reverse side 92, a central axis bore 94, a circular array of pin holes 96, and a peripheral wall 98 extending outward from the obverse side 90, wherein FIG. 9A is a perspective view of the obverse side 90 of the inner cap 84; FIG. 9B is a side perspective view of the inner cap 84; and FIG. 9C is a perspective view of the reverse side 92 of the inner cap 84.

Each pin hole 100 is spaced equidistant from each next adjacent pin hole 100. The peripheral wall 98 is divided by spacing slots 102 with each spacing slot 102 being spaced equidistant from each next adjacent spacing slot 102. The exemplary inner cap 84 depicted facilitates uniform spacing throughout the ball basket 28 structure by capturing and securing each arc rod 24 in pin holes 100 and spacing slots 102.

Preferably, there are the same number of pin holes 100 as spacing slots 102, and each pin hole 100 lies on a radius extending from the axis of rotation A through that pin hole 100 and the spacing slot 102 (radially related to the pin hole 100) is oriented to align along the radius. For purposes of this disclosure a pin hole 100 is radially related to a spacing slot 102 if the radius extends through both the pin hole 100 and the spacing slot 102.

Figure 10A:
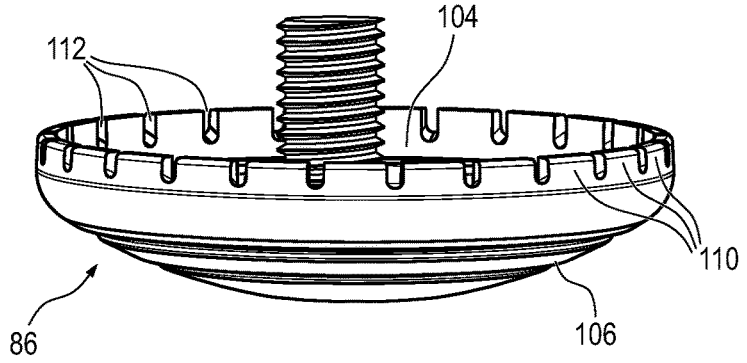
Figure 10B:
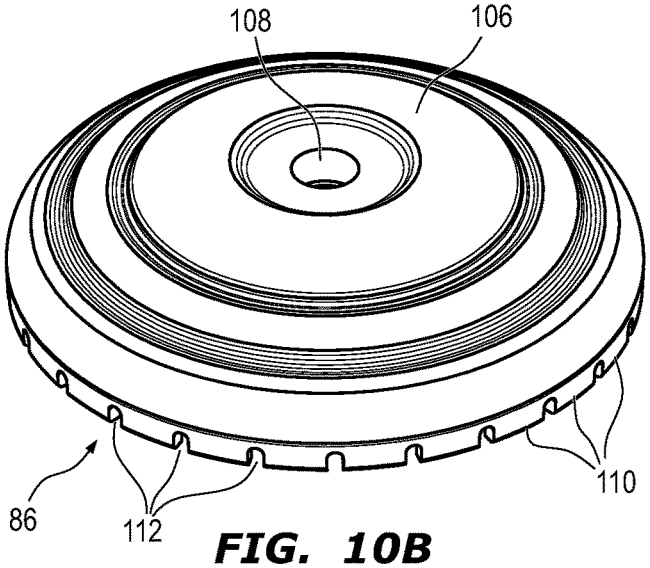
Figure 10C:
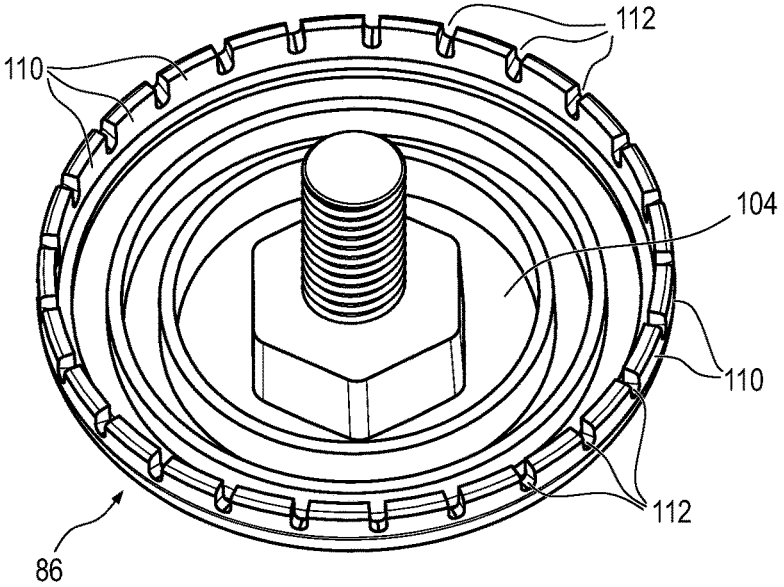

FIGS. 10A-C depict various views of an exemplary outer cap 86 for the rotatable hub 26, wherein FIG. 10A is a side perspective view of the outer cap 86; FIG. 10B is a perspective view of a concave obverse side 104 of the outer cap 86; and FIG. 10C is a perspective view of the convex reverse side 106 of the outer cap 86. The outer cap 86 is dome-shaped with the concave obverse side 104 and the convex reverse side 106 and has an aligning central axis bore 108 and a peripheral base wall 110 divided by corresponding spacing slots 112. The inner cap 84 and outer cap 86 of each rotatable hub 26 are connected in overlapping rotational alignment such that each spacing slot 102 of the inner cap 84 aligns with one of the corresponding spacing slots 112 of the outer cap 86. Also, each rotatable hub 26 is disposed with the reverse side 92 of the inner cap 84 facing inwardly (i.e., facing the interior volume 30 of the ball basket 28) and the convex reverse side 106 of the outer cap 86 facing outwardly with the central axis bore 94 and the aligning central axis bore 108 being centered about the axis of rotation A of the rotatable ball basket 16. The exemplary outer cap 86 depicted facilitates uniform spacing by clamping each arc rod 24 within the spacing slots 102 of the inner cap 84 and the aligned, opposite facing corresponding spacing slots 112. Also shown are a bolt shaft and a nut (without reference numbers) which may be used to firmly secure the overlapping connection without impeding the rotation of the rotational ball basket 16 about the axles 38.

As best shown in FIGS. 9A and 9B, each embeddable end 72 of each arc rod 24 is embedded in one or the other of the inner caps 84 by insertion into one of the pin holes 100 (see arrow F of FIG. 9A) such that the radial arm 76 of the arc rod 24 is captured between the radially related spacing slot 102 and its corresponding spacing slot 112 (as best shown in FIGS. 8 and 9B). When so captured, an exterior portion 114 of the radial arm 76 extends radially outward from the rotatable hub 26 to the elbow 78. The length of the exterior portion 114 of the radial arm 76 together with the stiffness of the arc rod 24 are principal factors in determining the amount of resilient deflection the arc rod 24 will tolerate. For purposes of this disclosure the term "resilient deflection" means the amount of deflection that any portion of any arc rod 24 may withstand without being deformed or damaged while maintaining its resiliency when the rotatable ball basket 16 retrieves a ball 12 into its interior volume 30 or when a ball 12 is accessed and removed from the rotatable ball basket 16.

Additionally, each arc rod 24 has a midpoint 82 and the transverse distance between the midpoints 82 of adjacent arc rods 24 ranges between an open space distance G (shown in FIG. 4) that is the maximum transverse distance between non-deflected adjacent arc rods, and a yawn opening distance that is the open space distance plus the sum of the distances of maximum resilient deflection of each adjacent arc rod 24. Because any ball 12 that passes into or out of the rotatable ball basket 16 must pass between adjacent arc rods 24, any ball 12 having a diameter less than the open space distance G cannot be retrieved and any ball 12 having a diameter greater than the yawn opening distance cannot be retrieved or removed without deforming or damaging one or more arc rods 24.

These limits on the transverse distance between midpoints 82 set general parameters for the diameter of balls 12, but other factors determine an operative range of diameters which will determine optimum efficiency in the use of the ball shagger 14. For example, a rotatable ball basket 28 having an open space distance G ranging between 27 mm and 33.5 mm (approximately 1.063 in. to 1.32 in.) is designed specifically to retrieve and dispense softballs and baseballs. Additionally, other types of balls of similar size to baseballs and softballs (for example, cricket balls, oversized tennis balls, some bocce balls, etc.), though not specifically designed for such other balls, likely are retrievable to be maintained within the ball basket 28, subject to the weight of the other balls not being significantly heavier than baseballs and softballs. For perspective, a 12-inch softball has a 3.82-inch diameter, and standard baseballs range from 2.86 inches to 2.94 inches in diameter.

A ball basket 28 specifically designed for handling softballs and baseballs does not handle golf balls very well (in the U.S., regulation golf balls cannot have a diameter less than 1.68 inches). Although, a regulation golf ball 12 has a diameter of 1.68 inches which is greater than the minimum 1.063 inch open space distance G, some golf balls can be retrieved and retained within the ball basket 28, but if other balls 12 are added (whether golf balls or other larger balls 12) there comes a point where the weight exerted on one or more golf balls will push one or more golf balls out by deflecting the pertinent adjacent arc rods 24 or the arc rods 24 may be deflected (for example, when picking up a softball or a baseball) so that they can no longer retain golf balls that would otherwise rest on the deflected arc rods 24. Simply put, because balls 12 are round and the ball basket 28 interior volume 30 is round, any ball 12 will only be supported by no more than two adjacent arc rods 24. Consequently, if those adjacent arc rods 24 are deflected away from each other, enlarging the open space distance G, either by retrieving a larger diameter ball 12, or by the sheer weight of other balls 12 being exerted on a golf ball, that will cause the arc rods 24 to deflect sufficiently to allow that golf ball to fall out of the ball basket 28.

FIGS. 11A-C depict various views of an exemplary introducer funnel 116 for disposition within the end of the handle 18, wherein FIG. 11A is a perspective side view of the introducer funnel 116; FIG. 11B is a perspective end view of the funnel-shaped receiving end 48 of the introducer funnel 116; and FIG. 11C is a perspective end view of the insertion end 118 of the introducer funnel 116.

In one exemplary embodiment of the multifunctional ball shagger 10, the end of the handle 18 is hollow so that an introducer funnel 116 may be received and secured within that hollow. The introducer funnel 116 is an exemplary embodiment of a type of funnel-shaped receiving end 48 that facilitates the connection of the handle 18 to the centering column 56 of the support assembly 50. The introducer funnel 116 has a hollow frustoconical portion 118 and a tubular portion 120, where the hollow frustoconical portion 118, in a similar manner as the funnel-shaped receiving end 48, guides the centering column 56 into the tubular portion 120. The tubular portion 120 may be secured within the hollow of the handle 18 by any suitable means such as press-fit, adhesive attachment, or fastened by a fastener such as a screw or the like. The introducer funnel 116 assists the user 20 in maneuvering the end of the handle 18 over the centering column 56 and depressing detent push pins 62, if present, without needing to bend over.

FIG. 12 is a close-up view depicting a portion of the handle 18 secured to the support assembly 50. This depiction shows the handle section 44 with the grip 46, one detent bore 60 with the detent push pins 62 positioned in the detent bore 60, a female threaded end 122, and the introducer funnel 116. The support assembly 50 depicted is an exemplary embodiment having the legs 54 secured to the base mount 52 with screws 124 and a seating collar 68. The centering column 56 is obscured from view by the handle 18 and the seating collar 68.

The seating collar 68 has fins 70 upon which the hollow frustoconical portion 118 seats and urges the handle 18 to maintain its upright position even when the centering column 54 does not snugly fit within the handle 18.

Those skilled in the art will appreciate that the present embodiments are exemplary and representative and should not be limited to the embodiments shown and described.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A multifunctional ball shagger having a ball shagging mode for retrieving randomly scattered balls resting on the ground and a pedestal access mode for presenting access to retrieved balls at a comfortable height, the multifunctional ball shagger comprising:

a ball shagger comprising a rotatable ball basket connected to a handle, the rotatable ball basket has an axis of rotation and comprises a plurality of arc rods and a pair of spaced rotatable hubs, each arc rod having embeddable ends at each end of the arc rod, each rotatable hub captures and secures one of the embeddable ends of each arc rod such that each arc rod is spaced from each adjacent arc rod, thereby forming a basket defining an interior volume between each rotatable hub and inside of the arc rods, each rotatable hub further comprises:

an inner cap having a flat base plate with an obverse side and a reverse side, a central axis bore, a circular array of pin holes with each pin hole being spaced equidistant from each next adjacent pin hole, and a peripheral wall extending outward from the obverse side and being divided by spacing slots with each spacing slot being spaced equidistant from each next adjacent spacing slot, there being the same number of pin holes as spacing slots such that each pin hole radially relates to one spacing slot;

an outer cap being dome-shaped with a convex obverse side and a concave reverse side, an aligning central axis bore, a peripheral base wall divided by corresponding spacing slots; and a support assembly for receiving the ball shagger in an upright disposition, at least a portion of the support assembly being disposed upon a supporting surface and comprising a base mount and a centering column;

the multifunctional ball shagger is in the pedestal access mode when the ball shagger handle is connected to the support assembly and disposed upright such that the rotatable ball basket is held above the supporting surface at a predetermined pedestal height;

the multifunctional ball shagger is in the ball shagging mode when the ball shagger handle is disengaged from the support assembly, the handle is disposed at an angle to the ground, and the rotatable ball basket engages the ground; and wherein the inner cap and outer cap of each rotatable hub are connected in overlapping rotational alignment such that each spacing slot of the inner cap aligns with one of the corresponding spacing slots of the outer cap, each rotatable hub is disposed with the reverse side of the inner cap facing inwardly and the convex obverse side of the outer cap facing outwardly with the central axis bore and the aligning central axis bore being centered about the axis of rotation of the rotatable ball basket, one embeddable end of each arc rod is embedded in the inner cap by insertion into each pin hole such that the radial arm of the arc rod is captured between the radially related spacing slot and its corresponding spacing slot with an exterior portion of the radial arm extending radially outward from the rotatable hub to the elbow.

2. The multifunctional ball shagger of claim 1 wherein the rotatable ball basket is rotatably connected to the handle by a basket holder, the basket holder having a two-pronged configuration with a central portion, each prong extends from the central portion and has an axle centered about the axis of rotation that aligns with the other axle also centered about the axis of rotation, the central portion also comprises a connector that connects the basket holder to the handle.

3. The multifunctional ball shagger of claim 1 wherein each arc rod further comprises a radial arm extending from each embeddable end to an elbow, and an arc portion extending between each elbow, each arc rod has a circular cross-section with a diameter of at least 2 mm.

4. The multifunctional ball shagger of claim 1 wherein the length of the exterior portion of the radial arm together with the stiffness of the arc rod determines the amount of resilient deflection the arc rod will tolerate.

5. The multifunctional ball shagger of claim 4 wherein each arc rod has a midpoint and the transverse distance between the midpoints of adjacent arc rods ranges between an open space distance that is the maximum transverse distance between non-deflected adjacent arc rods and a yawn opening distance that is the open space distance plus the sum of the distances of maximum resilient deflection of each adjacent arc rod.

6. The multifunctional ball shagger of claim 5 wherein the ball shagger will retrieve and capture a ball within the internal volume of the ball basket when the diameter of the ball is greater than the open space distance and less than the yawn opening distance.

7. The multifunctional ball shagger of claim 1 wherein the handle further comprises a funnel-shaped receiving end, the funnel-shaped receiving end for facilitating the connection of the handle to the centering column of the support assembly.

8. The ball shagger assembly of claim 7 wherein the centering column comprises at least one detent push pin and the funnel-shaped receiving end depresses at least one detent push pin allowing the insertion of the centering column into the handle.

9. The multifunctional ball shagger of claim 1 wherein the predetermined pedestal height is adjustable.

10. A multifunctional ball shagger having a ball shagging mode for retrieving randomly scattered balls resting on the ground and a pedestal access mode for presenting access to retrieved balls at a comfortable height, the multifunctional ball shagger comprising:

a ball shagger comprising a rotatable ball basket connected to a handle, the rotatable ball basket has an axis of rotation and comprises a plurality of arc rods and a pair of spaced rotatable hubs, each arc rod having embeddable ends at each end of the arc rod, each rotatable hub captures and secures one of the embeddable ends of each arc rod such that each arc rod is spaced from each adjacent arc rod, thereby forming a basket defining an interior volume between each rotatable hub and inside of the arc rods, each rotatable hub further comprises:

an inner cap having a flat base plate with an obverse side and a reverse side, a central axis bore, a circular array of pin holes, and a peripheral wall extending outward from the obverse side and being divided by spacing slots; and an outer cap being dome-shaped with a convex obverse side and a concave reverse side, an aligning central axis bore, a peripheral base wall divided by corresponding spacing slots; and a support assembly for receiving the ball shagger in an upright disposition, at least a portion of the support assembly being disposed upon a supporting surface and comprising a base mount and a centering column;

the multifunctional ball shagger is in the pedestal access mode when the ball shagger handle is connected to the support assembly and disposed upright such that the rotatable ball basket is held above the supporting surface at a predetermined pedestal height; and the multifunctional ball shagger is in the ball shagging mode when the ball shagger handle is disengaged from the support assembly, the handle is disposed at an angle to the ground, and the rotatable ball basket engages the ground.

* * * * *